US010190838B2

(12) United States Patent
Pittman

(10) Patent No.: US 10,190,838 B2
(45) Date of Patent: Jan. 29, 2019

(54) GUN SAFETY DEVICE

(71) Applicant: John M. Pittman, St. Albans, ME (US)

(72) Inventor: John M. Pittman, St. Albans, ME (US)

( * ) Notice: Subject to any disclaimer, the term of this patent is extended or adjusted under 35 U.S.C. 154(b) by 0 days.

(21) Appl. No.: 15/974,465

(22) Filed: May 8, 2018

(65) Prior Publication Data

US 2018/0259283 A1 Sep. 13, 2018

Related U.S. Application Data

(63) Continuation-in-part of application No. 15/727,095, filed on Oct. 6, 2017, now abandoned, which is a continuation-in-part of application No. 15/327,200, filed as application No. PCT/US2016/027329 on Apr. 13, 2016, now Pat. No. 9,784,517.

(60) Provisional application No. 62/146,543, filed on Apr. 13, 2015.

(51) Int. Cl.
*F41A 17/02* (2006.01)
*F41A 17/44* (2006.01)

(52) U.S. Cl.
CPC ..... *F41A 17/44* (2013.01)

(58) Field of Classification Search
CPC ..... F41A 17/44; F41A 17/02
USPC ..... 42/70.11
See application file for complete search history.

(56) References Cited

U.S. PATENT DOCUMENTS 9,784,517 B2 * 10/2017 Pittman ..... F41A 17/02

* cited by examiner

*Primary Examiner* — Joshua E Freeman
(74) *Attorney, Agent, or Firm* — Caseiro Burke, LLC; Chris A. Caseiro

(57) ABSTRACT

A device for controlling access to a firearm having a barrel with various physical features proximal thereto, including a muzzle device. The device includes a lock housing with a cavity to receive the barrel. The device also includes a lock mechanism shaft coupled to a lock mechanism that is configured for rotational movement upon actuation of the lock mechanism. The lock mechanism shaft is coupled to a cam that moves axially upon rotation of the lock mechanism shaft. A bidirectional rotatable shaft is coupled to the cam and is insertable into the barrel of the firearm. Embodiments described include variants on the use of a plurality of tabs such as arm, tab, and/or housing configurations to receive and grasp the muzzle device, firearm fixed front sights, bead front sights and/or accessories such as, for example, Picatinny rails, vertical or near vertical serrations, cuts and/or grooves located on the distal lateral and ventral regions of the frame and/or slide.

14 Claims, 10 Drawing Sheets

4030
4010
4021a
4021
4021b
4000
4000a
4021c
4021d
45
4110
4110a 4030
4010
4021a
4021c
4021b
4021d
4021e
4021
45
4110
4110a 4020a
4075
4085
4080
4021a
4025
4100
4090
4020
4022a
4022
4010
12
DISTAL
4021c
4021
4012
4015
4100d
4013
4013a
4014
4015a
4015a
4016
48
4000a
4000
46
47
4021b
4021e 4030
40
45
44
4110
4110b
4110a
11
PROXIMAL

4030

4010
4010a
4012
4012a
4012b
4013
5013
4014
4021a
4021
4025
4021c
4110
4110b
4110a
4022
4022a
4020
4020a
4100
4100b
4100a
11
proximal
4090
4100c
4080
distal
12
4085
4075
4021c
4021d
4021e
4023
5015d
5015b
5015a 5030
5018
5018b
5018c
5018a
5015
5015e
5015f
5015g
5015c
5000
4000
4000a
4021b

6030

6030

5030

5030

GUN SAFETY DEVICE

BACKGROUND OF THE INVENTION

1. Field of the Invention

The present invention relates to devices for gun safety. In particular, the present invention relates to devices that prevent unauthorized use of a gun having some type of muzzle device coupled thereto, including other physical features located proximally to a firearm muzzle.

2. Background of the Invention

The present invention is an advancement over the gun safety device described in U.S. Pat. No. 5,699,687 that was issued on Dec. 23, 1997. The entire content of U.S. Pat. No. 5,699,687 is incorporated herein by reference. Improvements have been made to enhance the functionality of the device. Those improvements include the elimination of some components of the original device, the modification of some components of the original device and the addition of new components. A new actuating means of securing a firearm is introduced in the present invention. The invention described herein improves overall safety certainty, strengthens structural integrity, improves anti-tampering properties and reduces manufacturing costs. The invention can be used to secure a firearm that includes some type of muzzle device, such as a flash hider, a flash suppressor, a muzzle brake and/or a compensator. The invention also may accommodate those firearms that include fixed front sights, manufactured indentations, and serrations in the muzzle vicinity of the firearm.

SUMMARY OF THE INVENTION

The invention is designed to secure guns having a muzzle device such as a flash hider, a flash suppressor, a muzzle brake and/or a compensator. The invention may also be modified to secure firearms that possess a blade-like front sight, a bead-like front sight, and firearms with vertical and near-vertical serrations, accessories, flats, cuts and/or other indentations upon the slide and/or frame in the muzzle vicinity of the firearm. With respect to the original device described in the cited patent, most, but not all, improvements are to specific components: improving their function, strengthening them and their anti-tamper properties and making them easier and cheaper to produce. A few new components are added. A few components have been eliminated. This device is designed to further self-defend itself and resist tampering and defeat by commonly available means including: brute force, crushing, cutting, drilling, grinding and reverse installation. A goal of the device of the present invention is to damage or destroy, both itself and the firearm, before it is compromised.

The device in several embodiments includes a lock housing with a base component coupled to a receptacle component, wherein the receptacle component includes a cavity configured for insertion therein of the muzzle device and at least a portion of the muzzle and/or barrel. It also includes a key structure coupled to the base component of the lock housing, wherein the key structure is arranged to receive a key. A lock mechanism is coupled to the key structure and arranged for actuation by the key. A lock mechanism shaft is coupled to the lock mechanism and is configured for rotational movement upon actuation of the lock mechanism. The device also includes a cam having a distal end and a proximal end, wherein the distal end of the cam is in contact with the lock mechanism shaft such that rotational movement of the lock mechanism shaft causes axial movement of the cam. A bidirectional rotatable shaft is coupled to and within the proximal end of the cam and arranged for insertion into the muzzle of the firearm. A plurality of arms is coupled to a perimeter of the cam and arranged for pivotal and radial movement to secure the firearm muzzle device in the cavity of the lock housing. The arms include a plurality of tabs arranged on the plurality of arms for engagement with an exterior surface of the muzzle device to retain the muzzle device within the lock housing. The several embodiments of the invention described herein include variants on the arm, tab and/or housing configurations to receive and grasp firearm' fixed front sights, which are common to pistol, revolver and many rifle firearms, a bead front sight that is common to shotgun firearms and accessories such as, for example, Picatinny rails, vertical or near vertical serrations, cuts and/or grooves located on the distal lateral and ventral regions of the frame and/or slide, which is common to many pistol firearms.

The device also includes near the proximal end of the cam a notched disk with circumferential notches or indentations, wherein the notched disk is made of a material that protects distal and external surfaces of the muzzle device from abrasion and damage. A conically shaped bushing is located proximal to the notched disk arranged to occupy a cavity within a distal region of the muzzle device. The device further includes a snap ring arranged to fasten the notched disk and the conically shaped bushing together, wherein the bidirectional rotatable shaft is configured to protrude from the proximal end of the cam, penetrate through the notched disk, the conically shaped bushing and the snap ring and extend into the firearm barrel.

The device optionally includes a semi-flexible, bi-directionally rotating wand coupled to a proximal end of the bidirectional rotatable shaft, wherein the wand is arranged to extend through a remainder of an internal length or bore of the barrel of the firearm and the full length of its chamber, thus preventing the loading of a live round of ammunition in the firearm. Several embodiments thereof are described herein.

The device includes a self-protective cage-like structure arranged to protect the internal length of the device and the firearm against tampering and defeat. The cage-like structure may include a key disk, one or more support disks, lock housing rods or pins and a bushing, all possessing bi-directional rotational freedom of movement; as an anti-tamper means. Wherein the one or more support disks are located within an interior of the bushing and the lock housing configuration to provide internal lateral support against attempted compromise by crushing. The cage-like structure may be configured to shelter multiple types of firearms, multiple types of muzzle devices and multiple muzzle configurations. The bushing enjoys bi-directional rotational freedom of movement and internally protects the entire lock housing, cavity, all components within the lock housing, all of the muzzle device and at least a portion of the firearms barrel. The bushing may be a unitary structure, or it may be a combination of bushing components. The device may include a pyrrhic disk located adjacent to the lock mechanism. The device may include a lanyard retainer coupled to the lock housing. The conically shaped bushing may be superimposed over the bidirectional rotatable shaft to occupy the cavity within the distal region of the muzzle device. The conically shaped bushing and the notched disk center stabilize the firearm within the cavity of the lock housing during activation.

Three variants of the gun safety device are described herein in which the three configurations are substantially the same, with variations related to accommodation of firearms' particular physical characteristics. All three configurations prevent the loading of a live round of ammunition into the chamber by occupying the full lengths of bore and chamber. All three configurations employ the same mechanical processes. That is, they include an OEM keyed lock with a proximally located threaded shaft that actuates a mutually threaded cam. The cam actuates radially, both inwardly and outwardly, a plurality of arms, each including an inwardly oriented securing tab at its proximal and ventral end. The tabs differ in the three configurations as will be described. The arms in all three configurations possess tabs that originate and are anchored into a distally positioned foundation disk component. Each arm also possesses a curved flat spring on its dorsal surface that urges an arm radially and inwardly. All three configurations employ the same passive occupation of the firearm bore and chamber. An advantage of this passive occupation is that the device will serve firearms, with a chamber that does not possess a cartridge case rim within, such as .22 Cal., 22 Cal. Magnum and several vintage calibers such as 45-70 Government and 45-90 Government, to mention a few.

All three configurations further include housing variations to accommodate different sorts of muzzle arrangements, wherein different housing orifices receive and protectively shelter the muzzle vicinity, muzzle device and a proximal portion of the distal end of the barrel of a firearm. All three configurations protect internal and external surfaces of the firearm against abrasion and damage with components as described herein and by the employment of a plastic-like covering of internal components and surfaces. All three configurations' components support and align fellow components and possess components that support and stabilize their union with the firearm as well as eliminate looseness between the device and firearm.

All three configurations possess marks or grooves on the external surface of the lock housing that indicate to the user where to line up the firearm's muzzle vicinity and/or muzzle device against components within the lock housing for activation to occur. Activation of these three configurations is a three-step process: clockwise key movement prepares or opens the device to receive the firearm muzzle vicinity or muzzle device, counter-clockwise key movement allows the arms and tabs to retract inwardly grasping and securing the firearm and clockwise key movement reopens the device allowing firearm access and removal.

All three embodiments described herein also employ a comprehensive length and breadth, self-protective internal cage-like structure; with hardened, strategically positioned and bidirectionally rotating components including disks, pins and a bushing, as well as a solder-like pyrrhic disk. The physical characteristics of the arms and respective tab arrangements vary in response to the physical characteristics of the muzzle vicinity and/or muzzle device of the firearm served. So does the outside diameter, lengths of the shaft and wand reflect the inside diameter, lengths of the firearm bore and chamber. All of the configurations possess a bidirectionally rotating shaft and may possess a bidirectionally rotating and telescoping wand.

The lock housings of all three configurations include two complementary components that are welded together. All configurations possess a lanyard element. All three configurations benefit from component standardization, such as the OEM keyed lock mechanism. All three configurations lend themselves to long-run mass component production using CNC technology. All configurations may include a safety key. All three configurations are designed to be very difficult to defeat and do not indicate to a miscreant where they might begin to in their quest to defeat it. All three components are easily and inexpensively maintainable.

The following detailed description, the accompanying drawings and the appended claims will further describe the present invention.

DETAILED DESCRIPTION OF THE INVENTION

Figures 1, 2:
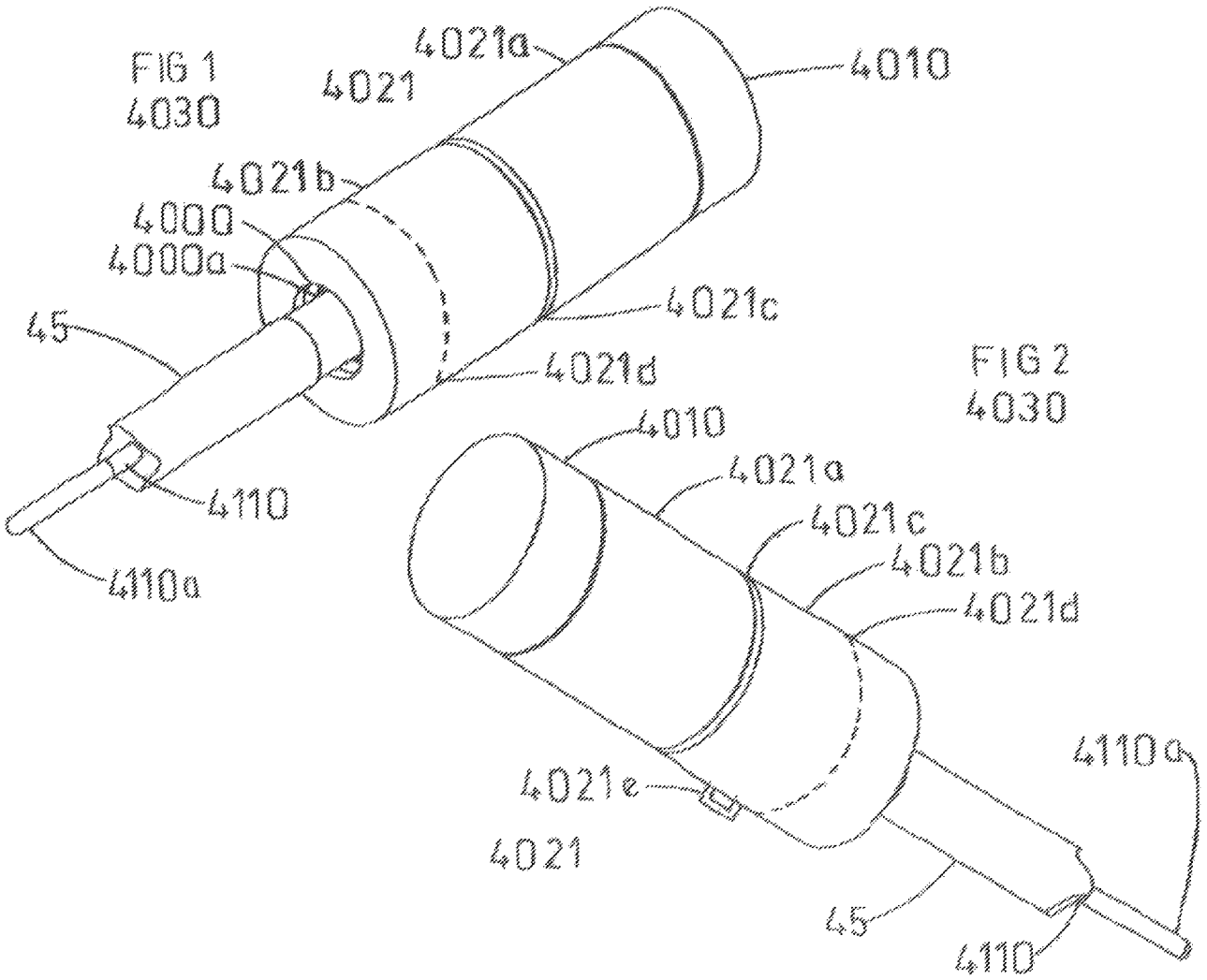
FIG. 1 is a first perspective view of a first embodiment of the firearm safety device of the present invention.
FIG. 2 is a second perspective view of the present invention shown in FIG. 1.
Figure 3:
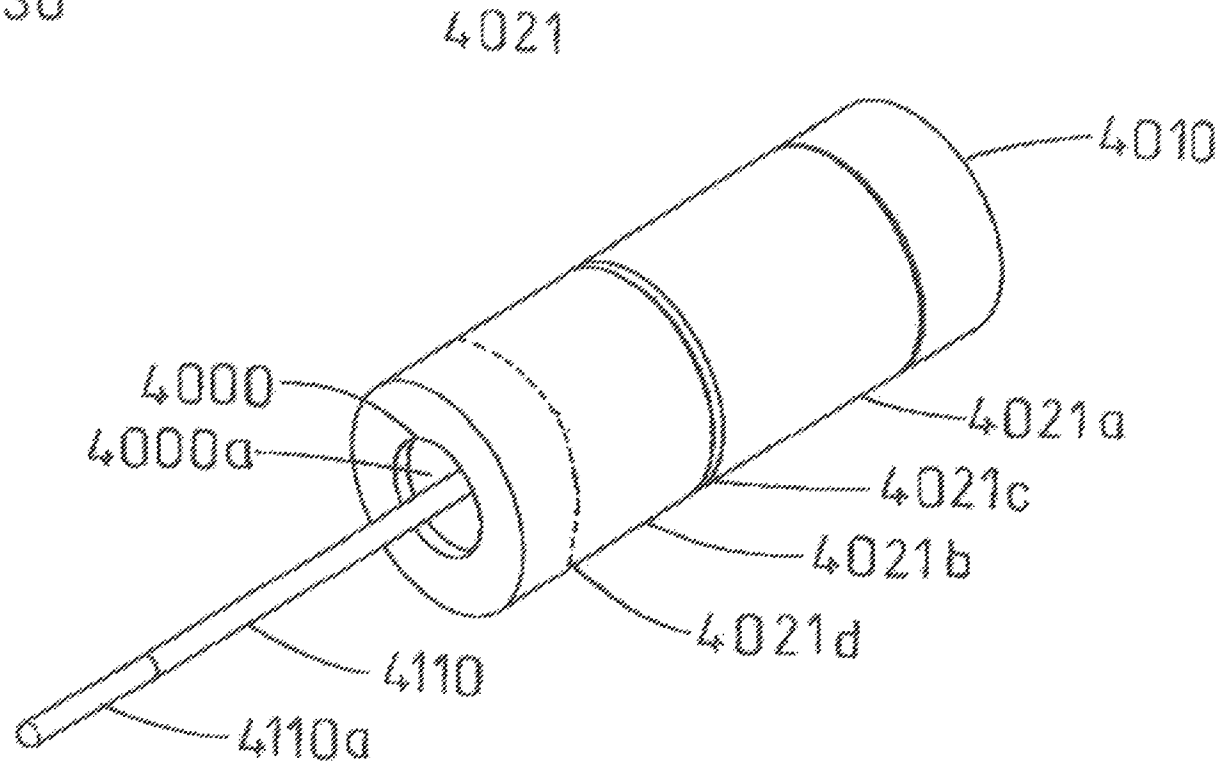
FIG. 3 is a third perspective view of the firearm safety device of the present invention shown in FIG. 1.
Figure 4:
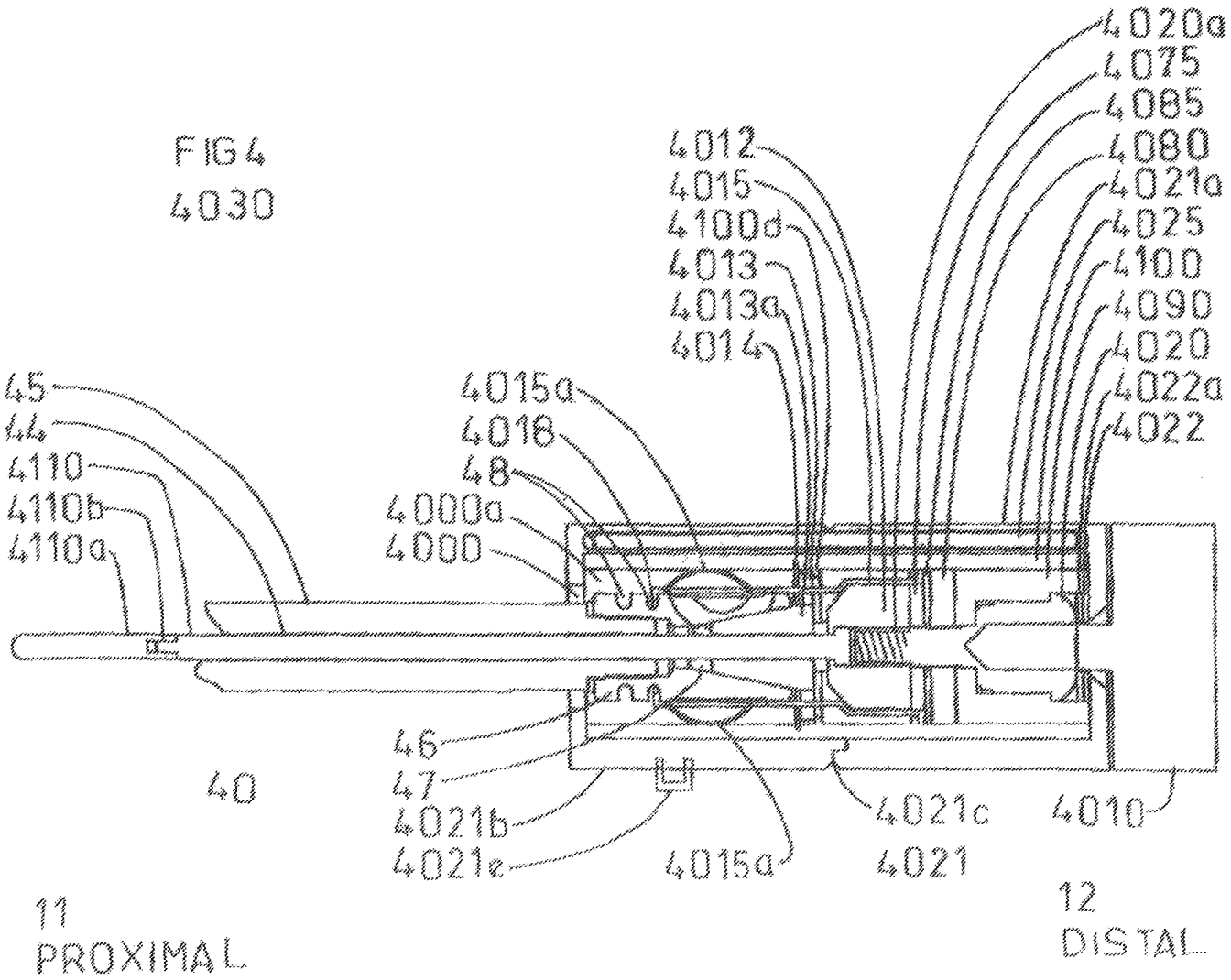
FIG. 4 is a perspective dissected view of the present invention shown in FIG. 1.

A first embodiment of a gun safety device 4030 of the present invention shown in FIGS. 1-5 is a type of locking mechanism that can be used to prevent firearm operation for those firearms having a muzzle device 46 such as a flash hider, a flash suppressor, a muzzle brake and/or a compensator affixed to the muzzle by preventing ammunition from being chambered by blocking the barrel 45 and chamber of the firearm 40.

The device 4030 includes an Original Equipment Manufacturer (OEM) key activated security pin tumbler or wafer tumbler screw-type lock mechanism 4020, a bidirectionally rotating shaft 4110, an arms foundation 4075, arms 4015 with tabs 4018 thereon, a lock housing 4021 and a lock foundation 4090 among other components. When the lock mechanism 4020 is actuated, a lock mechanism shaft **4020*a* that may be a threaded shaft 4020*a* upon a proximal terminus of the lock mechanism 4020 causes a cam 4012 to move axially in both proximal 11 and distal 12 directions, controlling a plurality of spring-urged arms 4015. Near the proximal end of this cam 4012 is a replaceable notched disk 4013, with circumferential notches or indentations, and that are shown as cross shaped in FIG. 5. The disk 4013 is made of a material that protects distal and external surfaces of the muzzle device 46 from abrasion and damage. Located proximally to the notched disk 4013, is a replaceable conically shaped bushing 4013*a* that occupies a cavity 47 within the distal region 12 of the firearm muzzle device 46. The notched disk 4013 and conically shaped bushing 4013*a* may be fastened in place with a snap ring 4014. The bidirectionally rotating shaft 4110 protrudes from the proximal end of the cam 4012, penetrates through the notched disk 4013, conically shaped bushing 4013***a* and snap ring 4014 and extends into the firearm's barrel. The shaft 4110 may include a semi-flexible, bidirectionally rotating wand 4110*a* at its proximal end. This wand 4110*a* extends through the rest of the internal length or bore 44 of the barrel 45 and the full length of its chamber, thus preventing the loading of a live round of ammunition in the firearm 40.

Responding to clockwise rotation of key structure 4010 and key 4010*a*, the cam 4012 migrates proximally 11 and urges all arms 4015 radially to the point where the firearm's muzzle or the muzzle device 46 located on the muzzle enters through an opening 4000, into the cavity 4000*a*, on a proximal end of lock housing receptacle 4021*b* where it is sheltered and superimposes over the device's shaft 4110, wand 4110*a* and conically shaped bushing 4013*a*. One or more marks, rings or circumferential grooves 4021*d* on the external surface of the lock housing configuration 4021 indicates to the user where to line up the firearm's muzzle and/or muzzle device against components within the lock housing configuration 4021 for activation to occur.

When the key structure 4010 or key 4010*a* is rotated in a counterclockwise manner, the cam 4012 migrates in a distal 12 direction, the arms 4015 are pivotally and inwardly urged by dorsal arm support springs 4015*a* thereon. On the ventral surface 4015*b* of each arm 4015 and/or at its terminus 4015*c*, is a very hard, reinforced and cushioned tab 4018 with dimensions that conform closely to the above-mentioned one or more grooves 48 on the muzzle device 46. These tabs 4018 firmly contact and grasp inner and lateral surfaces of grooves 48 of the muzzle device 46, thereby securing the firearm 40 and completing the activation or locking function of the device 4030.

Likewise, deactivation of the device 4030 takes place when one rotates the key structure 4010 or key 4010*a* in a clockwise direction, which causes the cam 4012 to migrate proximally, urging all arms 4015 radially to the point where the tabs 4018 thereon release their grasp within the grooves upon the muzzle device 48. At this point, the firearm's muzzle device or muzzle may be withdrawn through the device opening 4000 completing the deactivation or unlocking function of the device 4030.

In the present invention, actuation takes place in the distal region 12 of the firearm 40, in the distal region 12 of the device 4030, within the cavity 4000*a* on the proximal 11 end of the lock housing configuration 4021 securing against external surfaces of the firearm's muzzle device 46. Securing the firearm is accomplished by the "passive" occupation of the full length of the bore 44 and chamber with shaft 4110 and/or wand 4110*a* components; thus, the new activating means referenced above.

The device 4030 includes a self-protective cage-like structure established by key disk 4022 and support disk 4022*a*, as well as lock housing rods or pins 4025 and bushing 4100; all of which possess bidirectional rotational freedom of movement. Singular or multiple internal support disk 4085 reside within interior 4100*c* of the bushing 4100, within the lock housing configuration 4021, at strategic locations and provide internal lateral support against attempted compromise by crushing. These components are made of durable, very hard, high quality and non-corrodible materials, such as a stainless steel. They have the same roles and characteristics as previously described in the original invention. This improved cage-like structure self protects the internal length and breadth of the device 4030, and the firearm 40, against tampering and defeat and may be modified to shelter multiple types of firearms 40, multiple muzzle devices 46 and multiple muzzle configurations.

Bushing 4100 enjoys bidirectional rotational freedom of movement. It is larger than the corresponding one of the original safety device and internally protects the entire lock housing configuration 4021, cavity 4000*a*, all of the components within the lock housing configuration 4021, all, or most of all, of the firearms muzzle device 46 and a portion of the firearms barrel 45. This component bolsters the above cage-like structure and serves as a self-protective and anti-tampering element. The bushing 4100 may be a unitary structure or it may be a combination of bushing components such as subcomponent 4100*a* and subcomponent 4100*b*.

In contrast to the configuration of the original invention, in the present invention represented by device 4030, a new lock housing configuration 4021 comprising base component 4021*a* and receptacle component 4021*b* is much longer, and that are joined together, such as by welding, at a weld point 4021*c*, during the assembly process. These components are manufactured of a very hard, high quality and corrosion resistant material, such as a stainless steel. The exterior surfaces of the lock housing configuration 4021 may be finished and/or knurled to obscure any weld point if desired.

The opening 4000 and cavity 4000*a* at the proximal end 11 of the lock housing receptacle 4021*b* accepts and shelters all, or most all, of the length of the muzzle device 46 and a distal section of the firearm's barrel 45 that is proximal to the muzzle device 46 and in a random fashion except for model-specific firearm safety devices. Presently, the lock housing configuration 4021 and its proximally positioned orifice 4000 may be modified to shelter multiple firearm types including generic or specific models of firearms. The configuration of the 'shelter' may take two forms: first, a "generic" form that will accept any firearm having outside muzzle vicinity dimensions are less than the internal dimensions of the cavity opening 4000; and second, a "model specific" form that conforms to and will accept a specific model of firearm. The cross-sectional shape of the device 4030 that serves firearms, with components that have a circular cross section, may be round. The cross-sectional shape of the device 4030 that serves firearms, with components that have a square and or rectangular cross section at the muzzle vicinity, may be square or rectangular as is found in the original embodiment. Within both generic and model specific scenarios, barrel lengths are assumed to be equal or nearly equal, with equal or nearly equal calibers.

All of the internal components within the lock housing 4021 configuration, in the improved design of the present invention are accessible while the device is disengaged and removed. Some of these components are accessible by the removal of a snap ring 4014 fastening means. The snap ring 4014, which is replaceable, serves to retain the above and distally 12 located notched disk 4013 and conically shaped bushing 4013*a* in place, against an internal circumferential tab 4100*d*. (See FIG. 4.) within the bushing configuration 4100. Snap rings may also fasten the above additional support disk 4085 in place. Snap rings engage within an interior channel, cut within the bushing interior 4100*c* or between components 4100*a* and 4100*b* comprising the bushing 4100. Optional fastening means are press fitted clamps upon counterbore screws 4023 as well as the counterbore screws 4023 by themselves. Multiple counterbore screws 4023 fasten the arms foundation 4075, support disk 4085, pyrrhic disk 4080 and lock foundation 4090 to the interior face of the lock housing base 4021*a*. These stainless steel counterbore screws 4023 may be accompanied with small, superimposed (over their shaft) and bi-directionally rotating bushings, serving as an anti-tamper means. Added benefits to this configuration is that a miscreant, who gains possession of a gun with this device installed, has no obvious place to begin in their quest to defeat it.

The lock housing configuration 4021 of the device 4030 of the present invention has been modified to include a lanyard retainer, which may be a press fitted U-shaped component 4021*e* (as shown), a cave-like structure machined into the lock housing configuration 4021 or by other means.

Lock foundation 4090 in conjunction with the above mentioned counterbore screws 4023 prevents rotation of the lock mechanism 4020 within the lock housing configuration 4021. This lock foundation component 4090 component is a collar, that circumferentially conforms to the inside diameter of the lock housing base 4021*a* and internally conforms to the physical characteristics of the lock mechanism 4020. It is superimposed around the lock mechanism 4020 and is fastened in place by an above fastening means.

The device 4030 includes the cam 4012, which may be a shaped cam, wherein the shape may be that of a pyramid atop a box but not limited thereto. When the lock mechanism 4020 is actuated in a clockwise manner, the cam 4012 is pushed in a proximal 11 direction, urging the arms 4015, pivotably and radially outward. Screw axial threading 4020*a* is found on the proximal terminus 11 of the lock mechanism 4020 and within a distal 12 interior 4012*b* and almost the full length of the cam 4012. The cam 4012 is not rotatable, in that faces 4012*a* thereon, located proximally 11 are in direct contact with distal 12 and ventral 4015*b* surfaces on the arms 4015, which are urged radially and inwardly by the arm-supported, curved, flat springs 4015*a* thereon. With respect to the original device, the cam 4012 is not constrained by material cross sectional requirements, is less vulnerable to tampering and defeat, is expected to be much less expensive to manufacture and may be modified to conform to the type of firearm configuration, characteristics of the muzzle device and/or the muzzle in the vicinity thereof.

Figure 5:
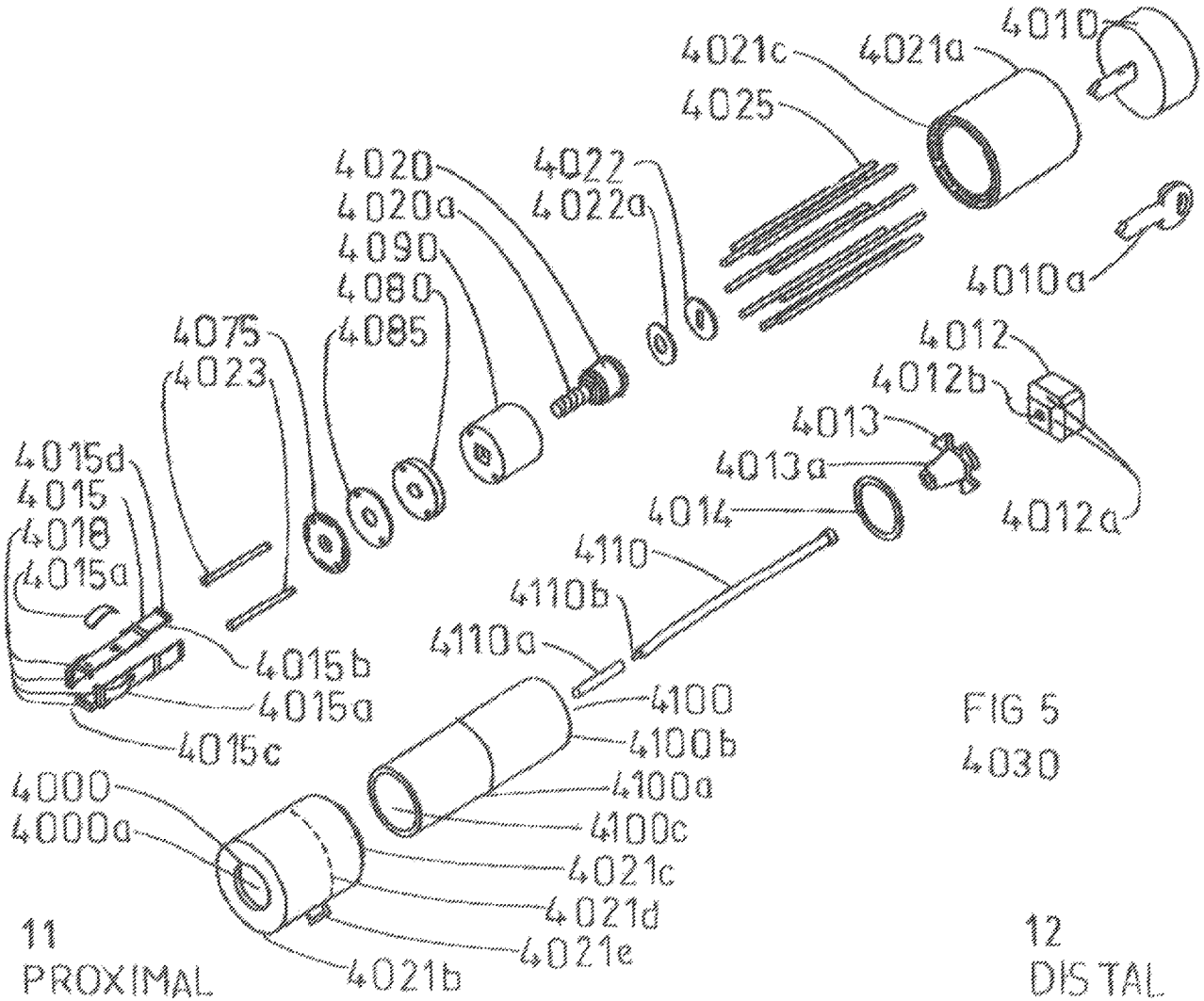
FIG. 5 is a perspective exploded view of the present invention shown in FIG. 1.

As illustrated in FIG. 5, four of the arms 4015 are shown on arms foundation 4075; however, more may be used including, for example, six or nine or more of them. The device 4030 may possess more or fewer such arms 4015, with their number and sizes selected as a function of the outside diameter of the muzzle device 46 or muzzle, length of the firearm's muzzle device 46, the type and configuration of the firearm, and its muzzle vicinity' physical characteristics. These arms 4015 possess distally located tabs 4015*d* that are distally anchored in the arms foundation 4075 and whose arms 4015 extend proximally 11 toward the cavity 4000*a* that shelters the firearms muzzle.

The device 4030 includes the plurality of tabs 4018 that, when the device 4030 is actuated, migrate inwardly to occupy and grasp grooves 48, on the firearm's muzzle device 46. The tabs 4018 may be either or both fixed (as shown) on the arms 4015 and movable, replaceable and adjustable on the arms 4015. This enables configurations of the device 4030 to conform to and secure both individual and multiple firearm muzzle devices 46. The tabs 4018 and/or the arms 4015 may be manufactured to identically conform to the physical characteristics of the muzzle device 46. Generally, the arms 4015 and tabs 4018 of this first embodiment 4030 will be identical, as the tabs 4018 occupy circumferential grooves 48 on a muzzle device 46. These tabs may be magnetized to hasten and bolster their employment.

The device 4030 includes bidirectionally rotating shaft 4110 that extends from within the cam 4012 proximally into the barrel of the firearm 40, cooperating with the conically shaped bushing 4013*a*, centering and stabilizing the firearm 40 within the device cavity 4000*a*. Materials employed in making the shaft 4110 are selected to be soft enough not to damage the internal surfaces of the barrel of the firearm 40 when actuated and otherwise when in contact with those surfaces. Threading 4110*b* at the proximal end 11 of the shaft 4110 accepts mutually threaded softer rods or wands 4110*a*. In firearms, with short barrel lengths, the bidirectionally rotating shaft 4110 may serve in lieu of the wand 4110*a*.

The device 4030 includes the semi-flexible wand 4110*a* component that is configured for bidirectional rotational freedom of movement. It serves to fully occupy the firearm's chamber as an anti-tamper means and is arranged for fastening at the proximal end 11 of the shaft 4110 thereby occupying the remainder of the barrel 45 and all of the chamber of the firearm 40. Many models of this type of firearm have different optional barrel lengths. One or more wands 4110*a*, which are attachable to the shaft 4110 and replaceable, may be cut to the total length of the barrel and chamber or wands 4110*a* may be telescoping, in which its most proximal section is urged proximally 11 into the chamber by internal coil springs. The telescoping nature of this embodiment of the wand 4110*a* allows a single wand to accommodate multiple barrel lengths. Materials employed in the manufacture of the wands 4110*a* are selected to be soft enough to not damage the internal surfaces of the firearm barrel and chamber and may be a hard rubber or plastic. Wand flexibility enables faster insertion and removal of the device 4030 to and from the firearm 40.

The device 4030 further includes the protective notched disk 4013 that is arranged to protect the proximal end 11 of the cam 4012 and external distal 12 surfaces of the muzzle device 46 and is made of a material or materials that are soft enough to not abrade or damage these surfaces. The outside diameter of the notched disk 4013 also serves to provide internal and lateral support to the device 4030 bushing configuration 4100 and also serves as a backstop for the conically shaped bushing 4013*a*. The cross-like notches on the circumference of this disk supports, aligns and guides the arms 4015 within the device 4030. The current configuration of arm 4015 alignment is radially outward. Another configuration which may be employed is radially inward by disks with internal circular notches corresponding to the arms that are cut within the inside diameter of a support disk 4085 or snap ring 4014. The notched disk 4013 may be expanded, modified, bolstered or merged with the conically shaped bushing 4013*a* to engage, support and protect a firearm's barrel, crown and muzzle vicinity.

The conically shaped bushing 4013*a* is superimposed over the device's bidirectionally rotating shaft 4110 and serves to occupy a cavity 47 within the distal region 12 of the muzzle device 46. Together, with the notched disk 4013, they center and stabilize the firearm within the device's cavity 4000*a* during activation, by eliminating looseness. This component consists of a material that will not abrade or damage the muzzle device's interior 47.

A smooth, hard plastic-like material covers the ventral surfaces 4015*b* of the arms 4015, the tabs 4018 on each arm 4015, the internal surface of the opening 4000 into the cavity 4000*a* and, optionally, within an internal lengths 4100*a* and 4100*b* of the bushing configuration 4100. These ventral surface cushions are hard, smooth, low friction and plastic-like; protecting external surfaces of the firearm's muzzle device, muzzle and front sight against abrasion, damage and facilitating both insertion and withdrawal of the firearm. These hard covers may be painted and baked on and/or heat-shrink applied. They provide component protection and also serve to reduce friction when inserting or removing the firearm from the device 4030.

The key structure 4010 may be a standard key 4010*a* (as shown), designed to be removed to allow the device 4030 to be maintained in a locked or unlocked position without the insertion of a key. Alternatively, the key structure 4010 may be a safety type (as shown), designed to be kept in place within the lock housing configuration 4021 so that the user of the invention may maintain the device 4030 in a locked position, while also being able to quickly unlock the device 4030 without reinsertion of the key 4010*a*. The surface of the key structure 4010 may be finished, knurled or otherwise modified to enhance one's grasp and handleability.

An additional element in accordance with this invention is a pyrrhic disk 4080. The pyrrhic disk 4080 is located in the vicinity of the lock mechanism 4020, cam 4012, arms foundation 4075, and the distal termini of the arms 4015*d*. The location of the pyrrhic disk 4080 is strategically chosen to be near the threaded 4020*a* proximal end 11 of the lock mechanism 4020 and its union with the cam 4012. The pyrrhic disk 4080 is manufactured of a solder-like material that will melt when exposed to extreme heat as well as friction-related heat generated by cutting with a saw, drilling and grinding. The solder-like material should be a metal that has a melting point at least as high as the temperature commonly attained by blow-torches. The effect is to cause the cam 4012, arms foundation 4075 and the distal 12 termini of the arms 4015*d* to be seized in place. Gaps within the arms foundation 4075, support disk 4085, lock foundation 4090 and the cavity within the lock housing 4000*a* enables molten material of the melted pyrrhic disk 4080 to migrate throughout the invention. This design, which allows molten material to migrate into the firearm, may be utilized to further dissuade unauthorized users from tampering with a firearm utilizing such an alternative design of the instant invention. It should be clear that such an alternative design is well within the scope of the present invention. Thus, pyrrhic disk 4080 is designed as a mechanism to protect against tampering via devices such as an acetylene torch.

Figure 6:
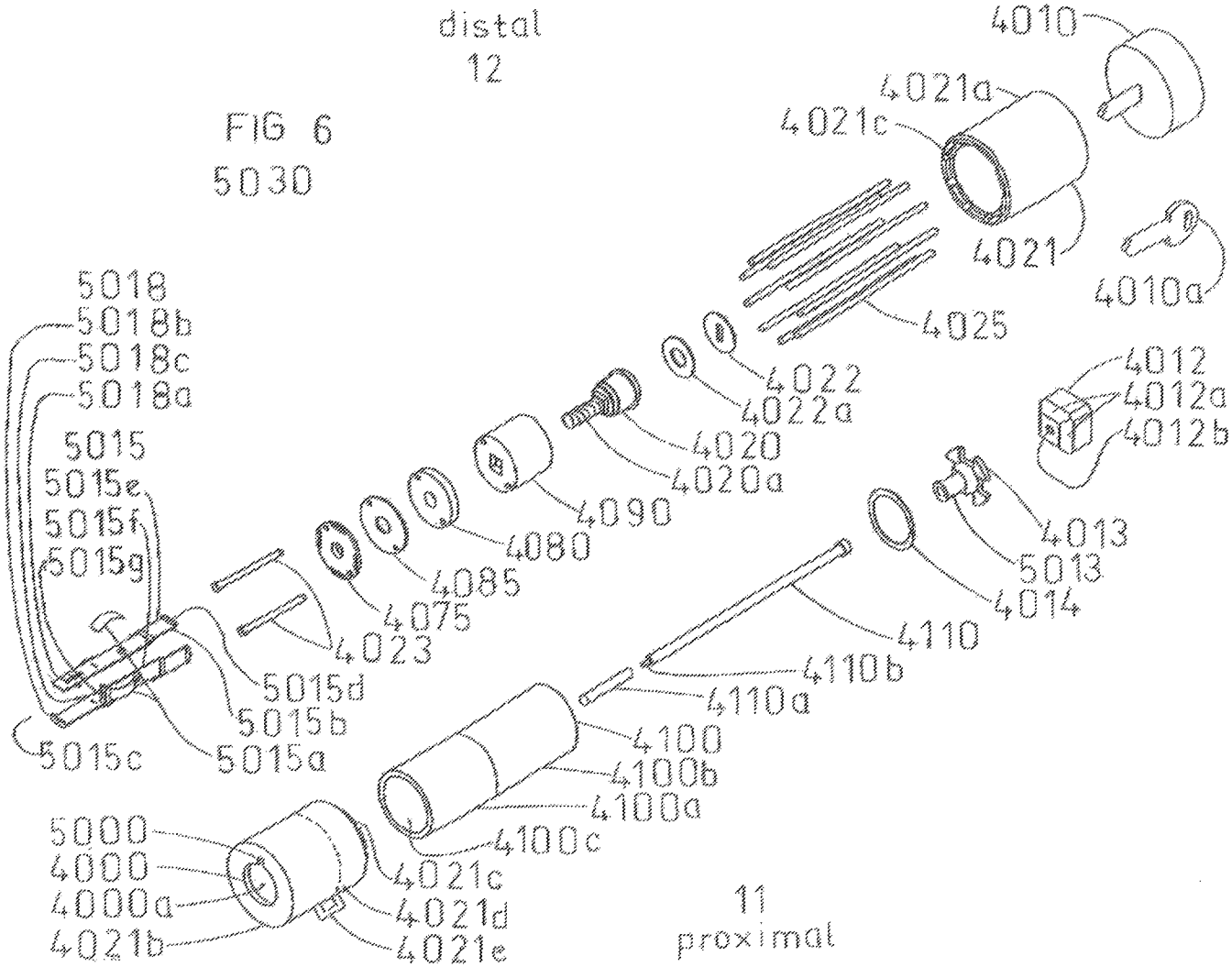
FIG. 6 is a perspective exploded view of a second embodiment of the firearm safety device of the present invention.
Figure 8:
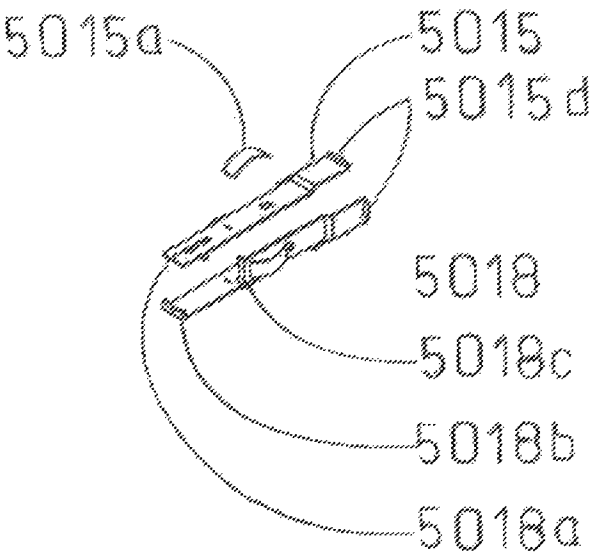
FIG. 8 is an exploded view of the arm with modified tabs of the firearm safety device of FIG. 6.
Figure 10:
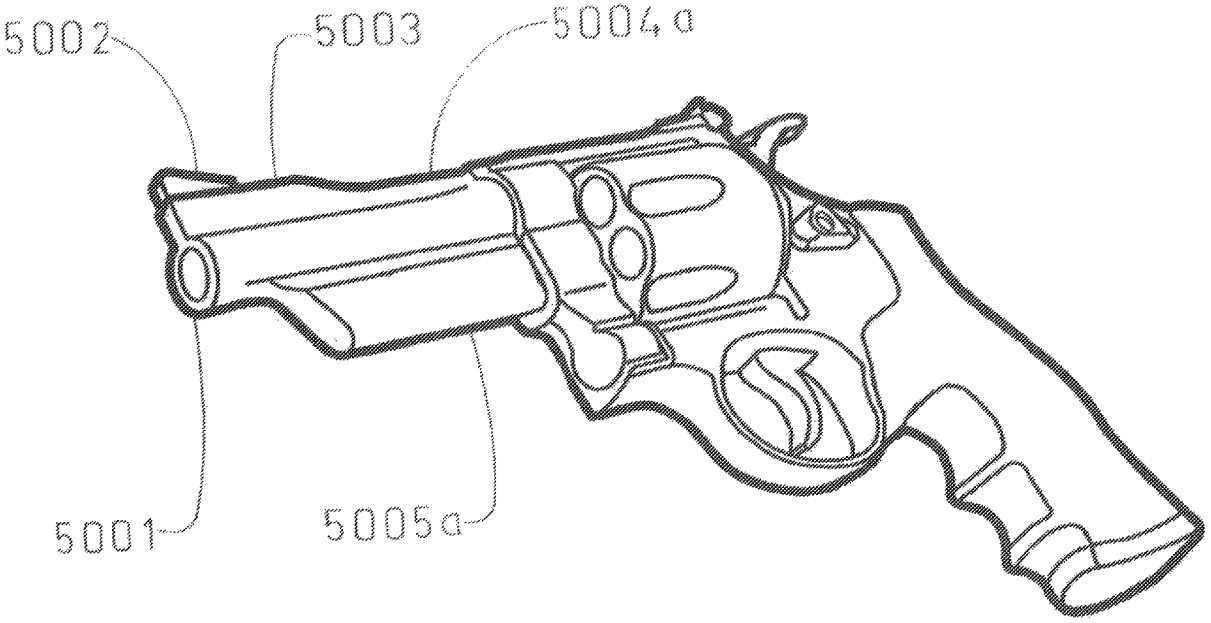
FIG. 10 is a perspective view of a first example firearm for which the firearm safety device of FIG. 6 is compatible.
Figure 11:
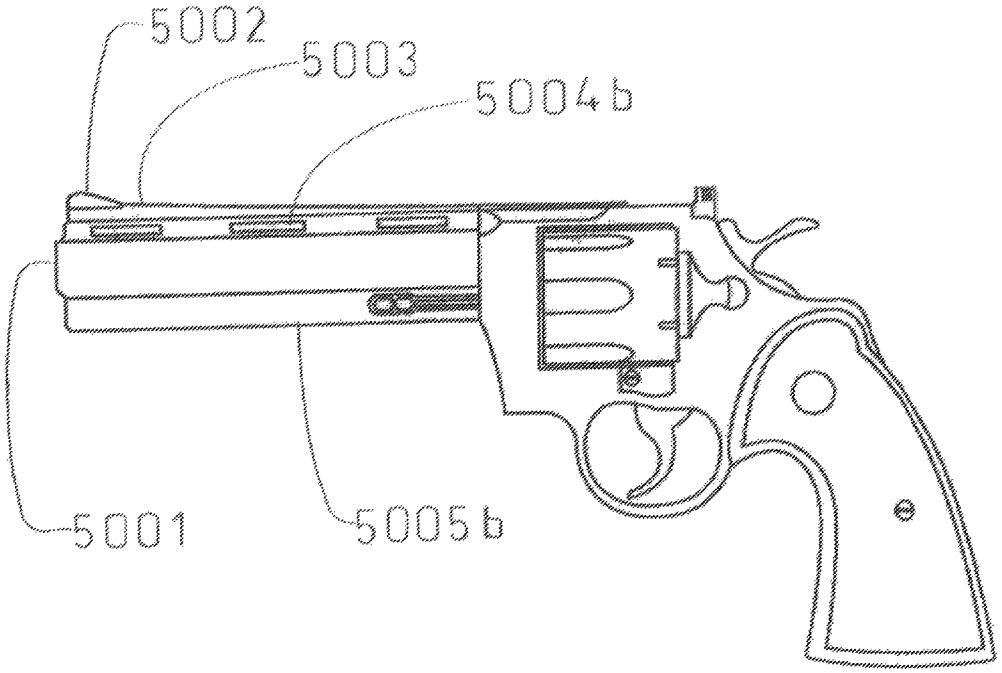
FIG. 11 is a side view of a second example firearm for which the firearm safety device of FIG. 6 is also compatible.

A second embodiment of a firearm safety device 5030 is represented in FIGS. 6 and 8. The device 5030 is suitable for use with a firearm having a construction such as the type represented in FIGS. 10 and 11 but is not limited thereto. That is, the device 5030 accommodates, receives, shelters and secures firearms that possess a blade-like front sight 5002, with or without a base or foundation 5003, and a barrel whose muzzle vicinity outside shape or cross section is nearly cylindrical or cylindrical 5001 as seen in FIGS. 10 and 11. Most often, these are revolver, rifle with front sight and single barrel shotgun types of firearms; although a few pistol firearms possess these features as well. A revolver blade-like front sight 5002 may be fixed directly onto the cylindrically shaped barrel 5001 or it may be fixed atop a base or foundation 5003, and/or a solid 5004*a* or ventilated 5004*b* rib. Revolver blade-like front sights, with or without a base or foundation 5003, are located relative to the location of the spent cartridge extractor rod and/or its housing 5005*a* (firearm example of FIG. 10) and 5005*b* (firearm example of FIG. 11). Spent cartridge extractor rods and their housings may be located ventrally directly below the blade-like front sight or are located off to either side of the ventral exterior of the barrel, extending from the frame along the barrel toward the muzzle. They may extend the full length 5005*b* or a partial length 5005*a* of the firearm barrel. Similarly, a rifle with a front blade-like sight may be fixed atop a base or foundation. A single barrel shotgun, which employs a bead-like front sight, may be fixed atop a solid or ventilated rib. There is a lot of muzzle vicinity variability within and between these types of firearms, which can be accommodated with the present invention.

The configuration of the device 5030 is very similar to the configuration of the device 4030 except for modifications to the arms 5015, tabs 5018, lock housing 4021, lock housing receptacle 4021*b* and small soft metal bushing 5013 components. Components of device 5030 that are identical to the components of device 4030 have the same numbers. Generally, the arms 4015 and tabs 4018 of the original configuration 4030 will be identical, as tabs 4018 occupy circumferential grooves on a muzzle device 46. As a result, embodiment 4080 of the device may rotate bi-directionally during installation and while activated. However, the arms 5015 and tabs 5018 of the device 5030 vary in number, length, width, depth and design to achieve an identical and physical match against external features and surfaces upon the firearm. Looking at the arms 5015 from the perspective at location 5015*c*, curved flat springs 5015*a*, located on the dorsal surface of arms 5015*e*, urge the arms 5015*d* radially inwardly until its proximally and ventrally located tabs 5018, which include 5018*a*, 5018*b* and 5018*c* components, simultaneously receive and grasp the blade-like front sight 5002, its base or foundation 5003, if any, and secure against other external features or surfaces upon the firearm at locations 5001, 5004*a*, 5004*b*, 5005*a* and 5005*b*. All arms 5015 and tabs 5018 will possess a hard rubber or plastic covering on those components' ventral surfaces 5015*b* to prevent abrasion and damage to the firearm's external surfaces. One or more marks, rings or circumferential grooves 4021*d* on the external surface of the lock housing receptacle 4021*b* indicates to the user where to line up the firearms muzzle against components within the lock housing configuration 4021 for activation to occur.

Top tab 5018*a* on arm 5015*e* of the device 5030 possesses a closed end four-sided rectangular or square slot or round receptacle, which will receive, descend inwardly over and secure the firearm's blade-like front sight, front sight base or foundation if any, or bead. Alternatively, or in addition, it may possess a three-sided open slot that is mated to a separate, inversely identical and opposing three-sided open slot on an adjacent arm. Bead-like front sights on shotguns require a circular shaped receptacle. Side tabs 5018*c* on arms 5015*f* have inwardly oriented, concave, plastic or rubber covered margins or pads, which conform to the outside diameter of the firearm's barrel and serve to prevent abrasion and damage as well as stabilize the device 5030 around the firearm. Bottom tab 5018*b* on arm 5015*g* may be identical to the side tabs 5018*c* on side arms 5015*f* or it may be modified to conform to, secure against, protect and stabilize the spent cartridge extractor rods and/or their housings 5005*a* and 5005*b*. See, for example, FIG. 8, showing a closer view of the arms and the curvature of the tabs.

The orifice 4000 and notch 5000 of the lock housing receptacle 4021*b* of the lock housing configuration 4021 is arranged to accommodate different types of firearms and their features. The notch 5000 on the proximal end opening 4000 of the lock housing receptacle 4021*b* allows a firearm's blade-like front sight and front sight base or foundation if any, entrance into cavity 4000*a*. Conically shaped bushing component 4013*a* has been modified into a small soft metal bushing 5013, which cooperates with the notched disk 4013, protects the firearm's internal and external surfaces, including the barrel' crown, against abrasion and damage. This small soft metal bushing component 5013 also centers and stabilizes the firearm within the devices cavity 4000*a* and eliminates looseness. Unlike embodiment 4030, embodiment 5030 does not possess relative rotational freedom of movement between the device 5030 and the firearm 40 during installation and activation. This results from the following components: the notch 5000 in the lock housing receptacle 4021*b*, top tabs 5018*a* and top arms 5015*d*.

Figure 7:
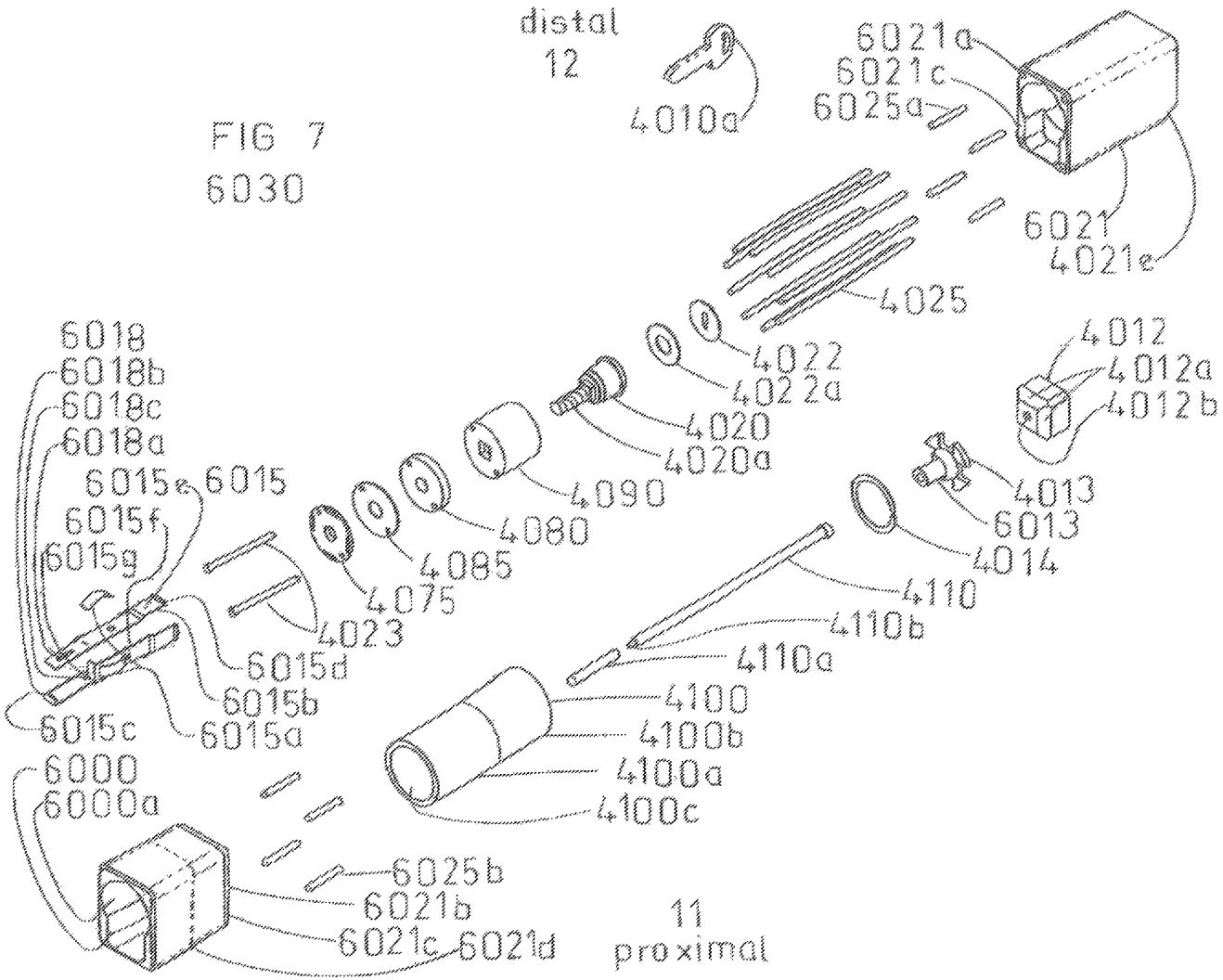
FIG. 7 is a perspective exploded view of a third embodiment of the firearm safety device of the present invention.
Figure 9:
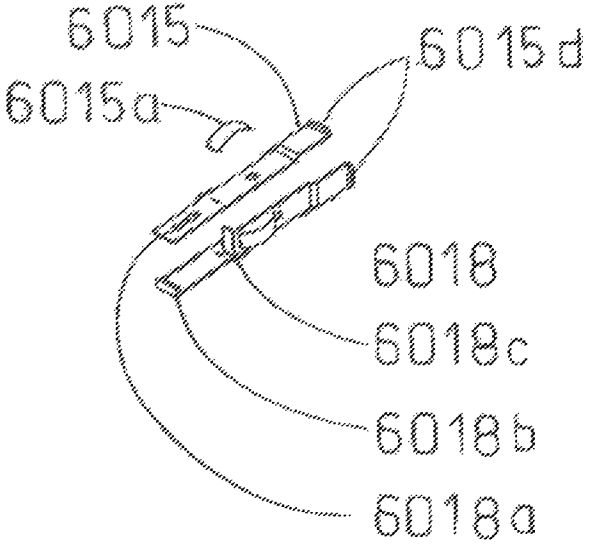
FIG. 9 is an exploded view of the arm with modified tabs of the firearm safety device of FIG. 7.
Figure 12:
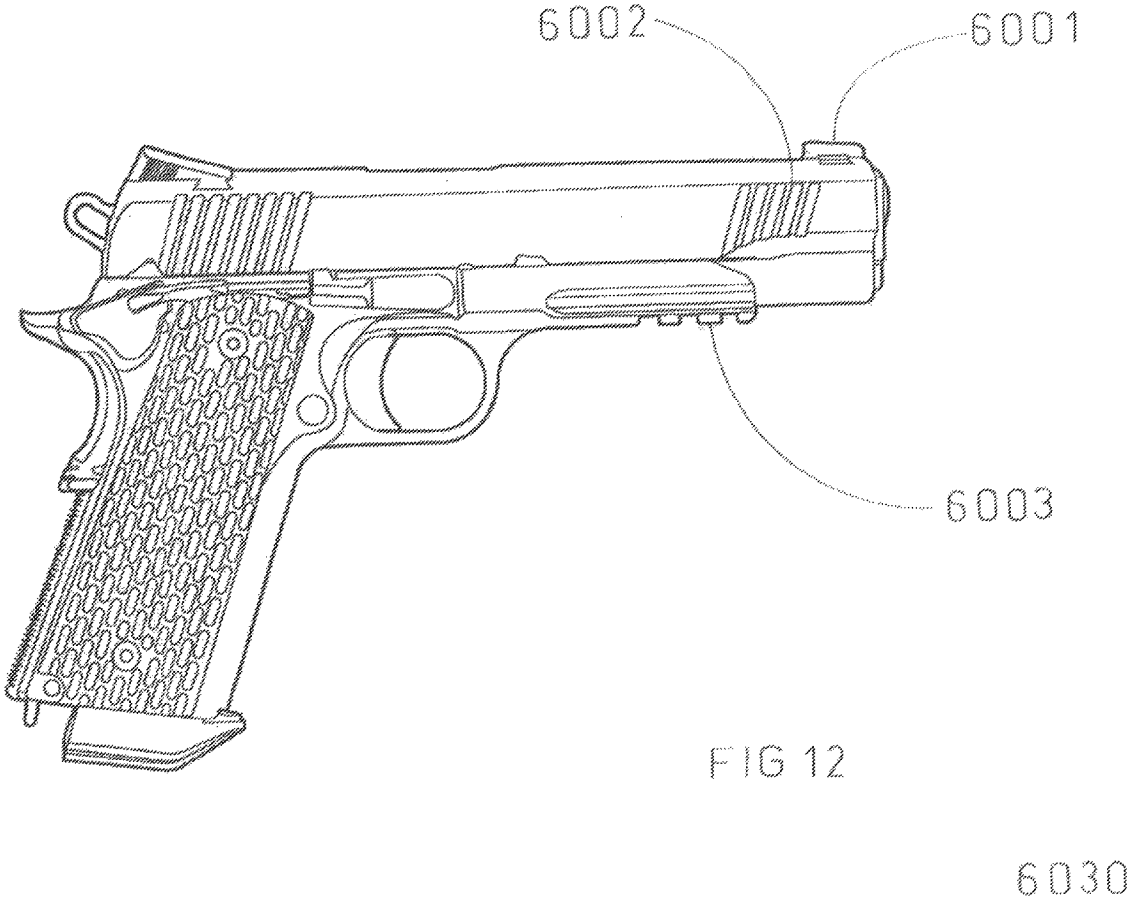
FIG. 12 is a side view of an example firearm for which the firearm safety device of FIG. 7 is compatible.

A third embodiment of a firearm safety device 6030 is represented in FIGS. 7 and 9. The device 6030 is suitable for use with a firearm having a construction such as the type represented in FIG. 12 but is not limited thereto. The device 6030 accommodates, receives, shelters and secures firearms that also possess a blade-like front sight 6001 and manufactured indentations, serrations 6002, flats, cuts and/or grooves 6003 made in the muzzle vicinity of the firearm slide and/or frame as shown in FIG. 12. These features are very common to the pistol type of firearm. Generally, pistol firearms do not possess a front sight base or foundation, as the front sight is fixed directly onto the slide. They also do not possess spent cartridge extractor rods and/or housings. The device 6030 may be modified to serve the double barrel shotgun type of firearm. Double barrel shotguns may be served with the addition of a bi-directionally rotating dummy wand 4110*a*, that occupies the full lengths of the barrel and chamber of the second unsecured barrel. Double barrel shotguns may possess solid or ventilated rib as well as a bead-like front sight. There is a lot of muzzle vicinity variability within and between these types of firearms, which can be accommodated with the present invention.

The device 6030 configuration is almost identical to the device 5030, except for a change in size, shape and depth of the lock housing configuration 6021, its components 6021*a* and 6021*b*, the size and characteristics of its orifice 6000 and cavity 6000*a*, as well as the types of firearms served. Components of device 6030 that are identical to the components of device 4030 have the same numbers. Generally, the arms 4015 and tabs 4018 of the configuration 4030 will be identical, as tabs 4018 occupy circumferential grooves on a muzzle device 46. As a result, configuration 4030 may rotate bi-directionally during installation and while activated. The device 6030 serves firearms that have a muzzle vicinity cross section shape that is square to rectangular. However, similar to embodiment 5030, the arms 6015 and tabs 6018 of the device 6030 vary in number, length, width, depth and design to achieve an identical and physical match against external features and surfaces upon the firearm of FIG. 12. Looking at the arms 6015 from the perspective at location 6015*c*, curved flat springs 6015*a*, located on the dorsal surface of arms 6015*e*, urge arms 6015*d* radially inwardly until its proximally and ventrally located tabs 6018, which include components 6018*a*, 6018*b* and 6018*c*, simultaneously receive and grasp the blade-like front sight 6001, serrations 6002 on distal and side surfaces of the slide and/or grooves on the ventral surfaces of the firearm frame 6003. All arms 6015 and tabs 6018 will possess a hard rubber or plastic covering on those components' ventral surfaces 6015*b* to prevent abrasion and damage to the firearm's external surfaces. Marks or grooves 6021*d* on the external surface of the lock housing receptacle 6021*b* indicate to the user where to line up the firearms muzzle against components within the lock housing configuration 6021 for activation to occur.

Top tab 6018*a* on arm 6015*e* of this configuration includes a closed end four-sided rectangular or square slot or round receptacle which will receive, descend inwardly over and secure the firearm's blade-like front sight or bead. Alternatively, or in addition, it may possess a three-sided open slot that is mated to a separate, inversely identical and opposing three-sided open slot on an adjacent arm. Bead-like front sights on shotguns require a circular receptacle. Side tabs 6018*c* on arms 6015*f* conform to and occupy serrations upon the firearm's slide and/or frame and may be oriented vertically or oriented to one side or the other and have straight or flat margins. Bottom tab 6018*b* on arm 6015*g* is designed to engage and secure against indentations and/or grooves commonly found on accessory rails, including Picatinny rails, and other features located on the distal ventral region of the frame of the firearm such as the example of FIG. 12. See, for example, FIG. 9, showing a closer view of the arms and the straight configuration of the tabs.

Orifice 6000 and cavity 6000*a* at the proximal end of the lock housing 6021 and lock housing receptacle 6021*b* receive and shelter the muzzle vicinity of the firearm. The lock housing 6021 is much larger than the corresponding housings of devices 4030 and 5030 in that orifice 6000 and cavity 6000*a* are much larger and deeper, as this configuration accommodates firearms with a larger rectangular or square cross section in the firearm muzzle vicinity. Hardened bidirectionally rotating steel pins 6025*a* and 6025*b* occupy slightly oversized drilled holes or cavities in the proximal end of the lock housing base 6021*a* and the distal end of the lock housing receptacle 6021*b* as a means of protecting the device's welded seams 6021*c* against compromise. The conically shaped bushing component 4013*a* of device 4030 is modified in device 6030 into a small soft metal bushing 6013, which cooperates with notched disk component 4013, protects the firearm internal and external surfaces, including the barrel' crown against abrasion and damage. This component 6013 also centers and stabilizes the firearm within the device's cavity 6000*a* and eliminates looseness. Unlike embodiment 4030, embodiment 6030 does not possess relative rotational freedom of movement between the device 6030 and the firearm 40 during installation and activation. This results from the following components: orifice 6000*a*, the lock housing receptacle 6021*b*, top tabs 6018*a* and top arms 6015*d*.

Although the present invention has been described with respect to specific embodiments, it is to be understood that it is not limited thereto and all equivalents are considered covered by the following claims.

What is claimed is:

1. A device for controlling access to a firearm having a barrel with one or more features located proximal to a muzzle of the firearm, the device comprising:

a lock housing with a base component coupled to a receptacle component, wherein the receptacle component includes a cavity configured for insertion therein of at least a portion of the barrel;

a key structure coupled to the base component of the lock housing, wherein the key structure is arranged to receive a key;

a lock mechanism coupled to the key structure and arranged for actuation by the key;

a lock mechanism shaft coupled to the lock mechanism and configured for rotational movement upon actuation of the lock mechanism;

a cam having a distal end and a proximal end, wherein the distal end of the cam is in contact with the lock mechanism shaft such that rotational movement of the lock mechanism shaft causes axial movement of the cam;

a bidirectional rotatable shaft coupled to the proximal end of the cam and arranged for insertion into the barrel;

a plurality of extended arms coupled to a perimeter of the cam and arranged for pivotal and radial movement to secure at least a portion of the barrel in the cavity of the lock housing; and a plurality of tabs arranged on the plurality of extended arms for engagement with an exterior surface of the barrel to retain the muzzle within the lock housing, wherein the plurality of tabs includes one or more top tabs arranged to secure any blade-like front sight, front sight base, foundation or bead of the firearm.

2. The device of claim 1 wherein the plurality of tabs includes two or more side tabs arranged to stabilize the device.

3. The device of claim 1 wherein the plurality of tabs includes one or more bottom tabs arranged to conform to, secure against, protect and stabilize any spent cartridge extractor rod, spent cartridge extractor rod housing, or both of the firearm.

4. The device of claim 1 further comprising near the proximal end of the cam a notched disk with circumferential notches or indentations that serve as guides to adjacent ones of the plurality of arms, wherein the notched disk is made of a material that protects distal and external surfaces of the firearm from abrasion and damage.

5. The device of claim 1 further comprising a semi-flexible, bi-directionally rotating wand coupled to a proximal end of the bi-directional rotatable shaft, wherein the wand is arranged to extend through a remainder of an internal length or bore of the barrel and the full length of its chamber, thus preventing the loading of a live round of ammunition in the firearm.

6. The device of claim 1 wherein the receptacle component of the lock housing includes a notch arranged to enable reception within the lock housing of a blade-like front sight, bead-like front sight, front sight base or foundation of the firearm.

7. The device of claim 1 further comprising a self-protective cage-like structure arranged to protect the internal length of the device and the firearm, wherein the cage-like structure includes a key disk, one or more support disks, lock housing rods or pins, a bushing and a pyrrhic disk, wherein the one or more support disks are located within an interior of the bushing and the lock housing configuration to provide internal lateral support against tampering and defeat, and wherein the disk, housing rods or pins and bushing enjoy bi-directional rotational freedom of movement and internally protect the entire lock housing, cavity, all components within the lock housing and at least a portion of the barrel.

8. The device of claim 4 further comprising a small soft metal bushing located proximal to the notched disk arranged to occupy the distal bore of the barrel that is proximal to the muzzle, wherein the soft metal bushing serves with the notched disk to center and stabilize the firearm within the cavity of the lock housing during activation, eliminate looseness and protect distal and internal surfaces of the barrel, including the crown, from abrasion and damage.

9. A device for controlling access to a firearm having a barrel with one or more features that are proximal to a muzzle of the firearm, the device comprising:

a lock housing with a base component coupled to a receptacle component, wherein the receptacle component includes a cavity configured for insertion therein of at least a portion of the barrel;

a key structure coupled to the base component of the lock housing, wherein the key structure is arranged to receive a key;

a lock mechanism coupled to the key structure and arranged for actuation by the key;

a lock mechanism shaft coupled to the lock mechanism and configured for rotational movement upon actuation of the lock mechanism;

a cam having a distal end and a proximal end, wherein the distal end of the cam is in contact with the lock mechanism shaft such that rotational movement of the lock mechanism shaft causes axial movement of the cam;

a bidirectional rotatable shaft coupled to the proximal end of the cam and arranged for insertion into the barrel;

a plurality of extended arms coupled to a perimeter of the cam and arranged for pivotal and radial movement to secure at least a portion of the barrel in the cavity of the lock housing; and a plurality of tabs arranged on the plurality of extended arms for engagement with an exterior surface of the firearm to retain the muzzle within the lock housing, wherein the plurality of tabs includes one or more top tabs arranged to secure any blade-like front sight or bead of the firearm and two or more side tabs arranged to occupy serrations on a slide or a frame of the firearm.

10. The device of claim 9 wherein the plurality of tabs includes one or more bottom tabs arranged to engage and secure against indentations, grooves of accessory rails or other features located on a distal ventral region of the frame of the firearm.

11. The device of claim 9 further comprising near the proximal end of the cam a notched disk with circumferential notches or indentations that serve as guides to adjacent ones of the plurality of arms, wherein the notched disk is made of a material that protects distal and external surfaces of the barrel, slide or frame from abrasion and damage.

12. The device of claim 9 further comprising a semi-flexible, bi-directionally rotating wand coupled to a proximal end of the bidirectional rotatable shaft, wherein the wand is arranged to extend through a remainder of an internal length or bore of the barrel and the full length of its chamber, thus preventing the loading of a live round of ammunition in the firearm.

13. The device of claim 9 further comprising a self-protective cage-like structure arranged to protect the internal length of the device and the firearm, wherein the cage-like structure includes a key disk, one or more support disks, lock housing rods or pins, a bushing and a pyrrhic disk, wherein the one or more support disks are located within an interior of the bushing and the lock housing configuration to provide internal lateral support against tampering and defeat, and wherein the disk, housing rods or pins and a singular or multi-component bushing enjoy bi-directional rotational freedom of movement and internally protect the entire lock housing cavity, all components within the lock housing and at least a portion of the barrel.

14. The device of claim 9 further comprising a small soft metal bushing located proximal to the notched disk arranged to occupy the distal bore of the barrel that is proximal to the muzzle, wherein the soft metal bushing serves with the notched disk to center and stabilize the firearm within the cavity of the lock housing during activation, eliminate looseness and protect distal and internal surfaces of the barrel, including the crown, from abrasion and damage.

* * * * *